US006331817B1

(12) United States Patent
Goldberg

(10) Patent No.: US 6,331,817 B1
(45) Date of Patent: Dec. 18, 2001

(54) OBJECT TRACKING APPARATUS AND METHOD

(75) Inventor: Steven Jeffrey Goldberg, Fort Worth, TX (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/584,615

(22) Filed: May 31, 2000

(51) Int. Cl.[7] ..... G08B 23/00

(52) U.S. Cl. ..... 340/573.1; 340/568.1; 340/572.1; 340/825.36; 340/10.1; 340/10.32

(58) Field of Search ..... 340/573.1, 571, 340/568.1, 568.6, 568.7, 572.1, 825.36, 825.37, 825.49, 10.1, 10.32, 539

(56) References Cited

U.S. PATENT DOCUMENTS 4,862,160 * 8/1989 Ekchian et al. ..... 340/825.54
5,396,218 * 3/1995 Olah ..... 340/572.1
5,677,673 * 10/1997 Kipnis ..... 340/539
5,680,105 * 10/1997 Hedrick ..... 340/571
5,686,891 * 11/1997 Sacca et al. ..... 340/571
5,781,109 * 7/1998 Nakajima ..... 340/568.1
5,939,981 * 8/1999 Renney ..... 340/539
5,949,328 * 9/1999 Latty ..... 340/326
5,952,921 * 9/1999 Donnelly ..... 340/568.6
6,002,334 * 12/1999 Dvorak ..... 340/568.1

* cited by examiner

*Primary Examiner*—Jeffery Hofsass
*Assistant Examiner*—Toan Pham
(74) *Attorney, Agent, or Firm*—Charles W. Bethards; Hisashi D. Watanabe

(57) ABSTRACT

A tracking apparatus includes a tracked object interrogator which produces a tracked object identifier output. The tracking apparatus also includes a location interrogator which produces an apparatus location output. The apparatus further includes an alarm which enunciates for a predetermined combination of the apparatus location output and the tracked object identifier output.

22 Claims, 9 Drawing Sheets

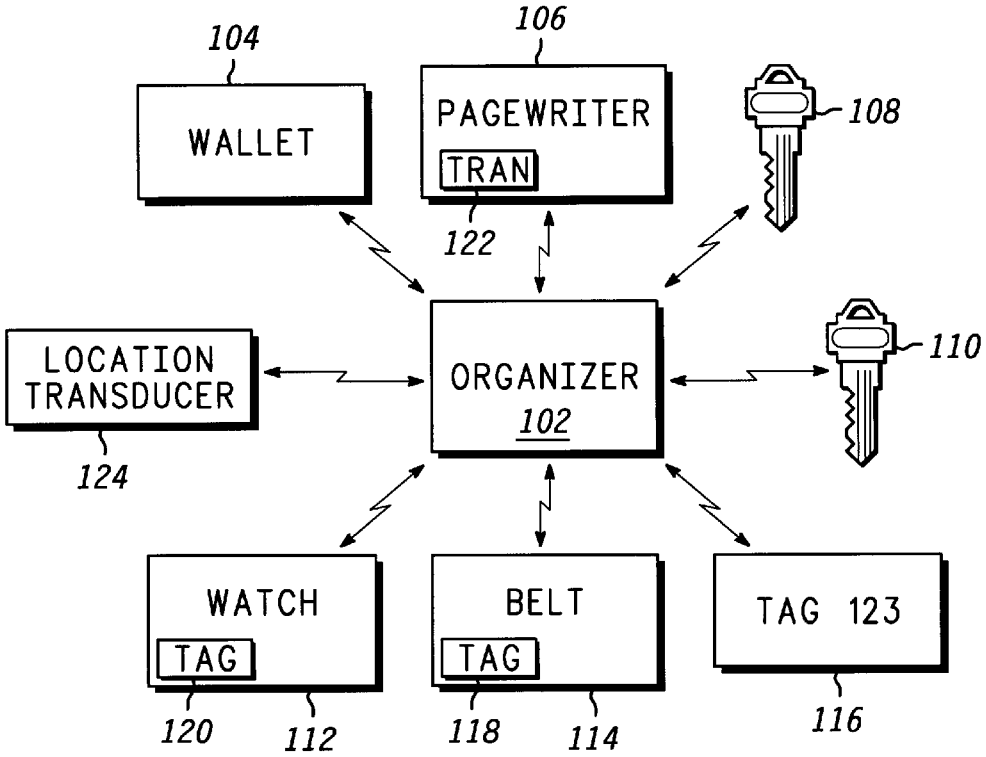
FIG. 1
FIG. 2
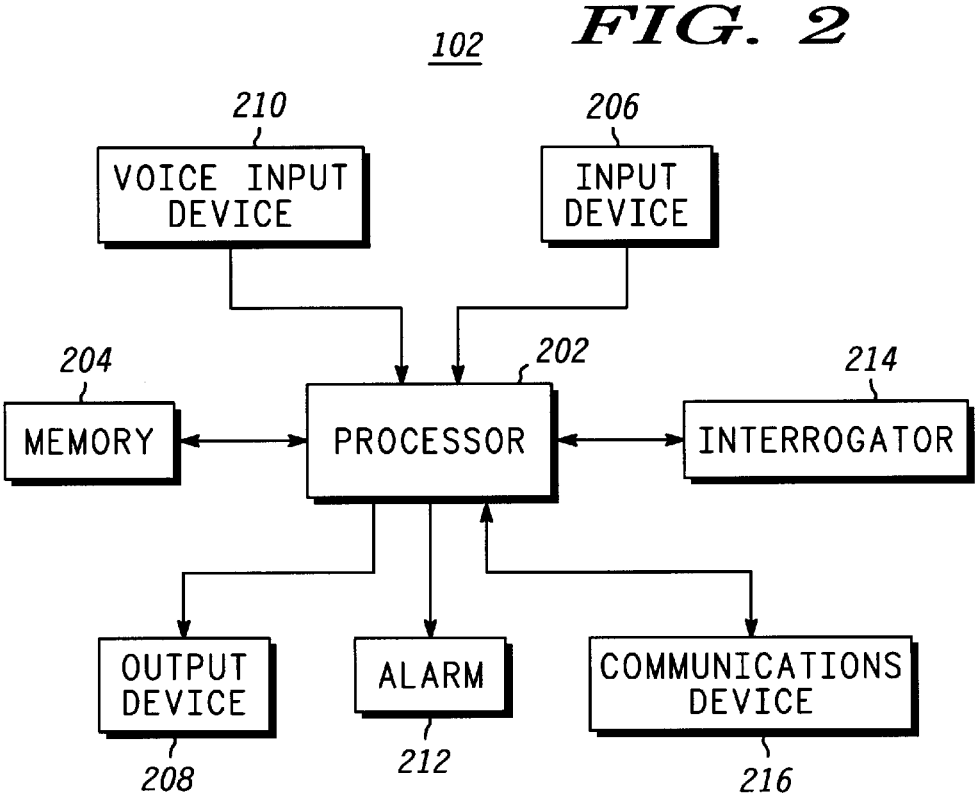

502 — LEAVING FOR WORK

CHECK OPTION:
WHEN LEAVING HOME (504) MONDAY THROUGH (506) FRIDAY AM (508)

MUST HAVE:
- PAGEWRITER
- PERSONAL KEYS
- OFFICE KEYS
- WALLET
- WATCH
- BELT
- TAG 123

} 510

```
                    602 — HIS CAR
                    604                          606
CHECK OPTION:
 ENTERING ALAN'S CAR PLUS LEAVING FOR WORK
 WHEN APPLICABLE
                                          608
MUST HAVE:
 STAYS IN CAR CELLPHONE
 WORK PARKING LOT GATE OPENER
```

FIG. 6

```
                    502 — LEAVING FOR WORK

CHECK OPTION:
   WHEN LEAVING HOME MONDAY THROUGH FRIDAY AM

MUST HAVE:                          IGNORE
   PAGEWRITER
   PERSONAL KEYS
   OFFICE KEYS-----MISSING          □
   WALLET
   WATCH
   BELT----------MISSING            □
   TAG 123
```

FIG. 7

```
                    602 — HIS CAR

CHECK OPTION:
   ENTERING ALAN'S CAR PLUS LEAVING FOR WORK
   WHEN APPLICABLE

MUST HAVE:                                      IGNORE
   STAYS IN CAR CELLPHONE
   WORK PARKING LOT GATE OPENER--MISSING        □
```

FIG. 8

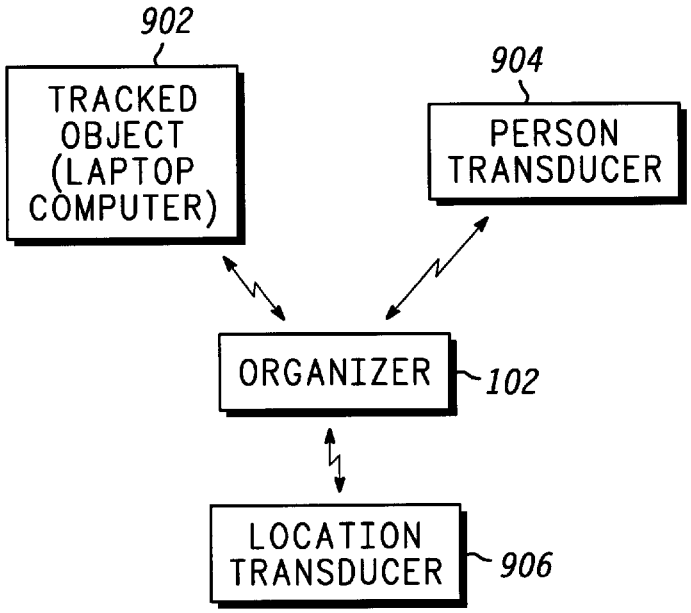
FIG. 9
FIG. 10
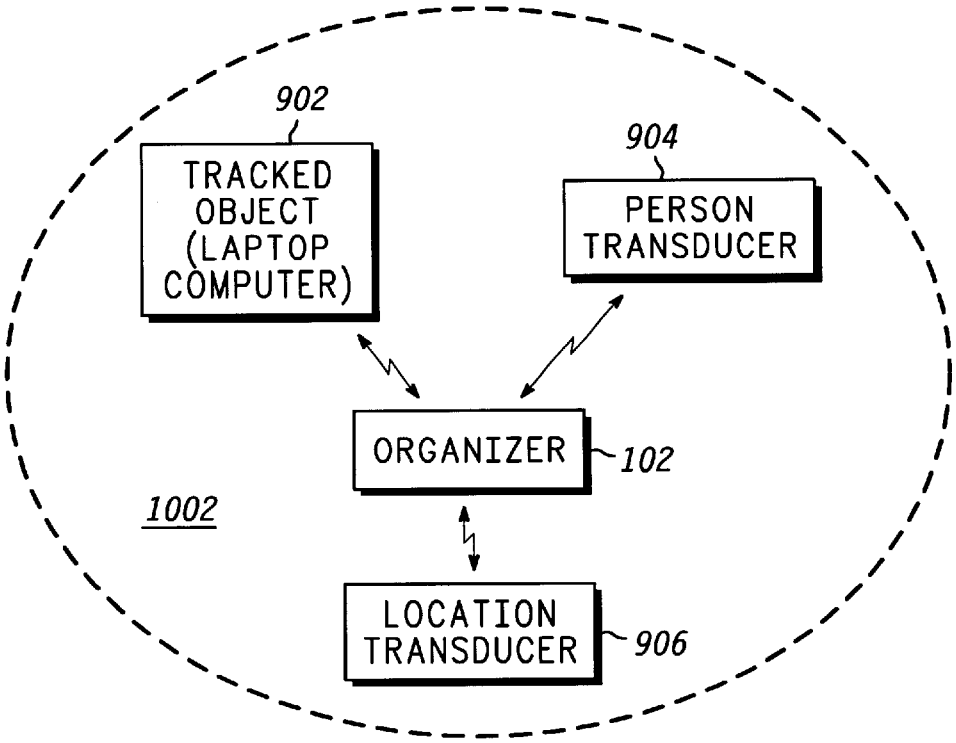

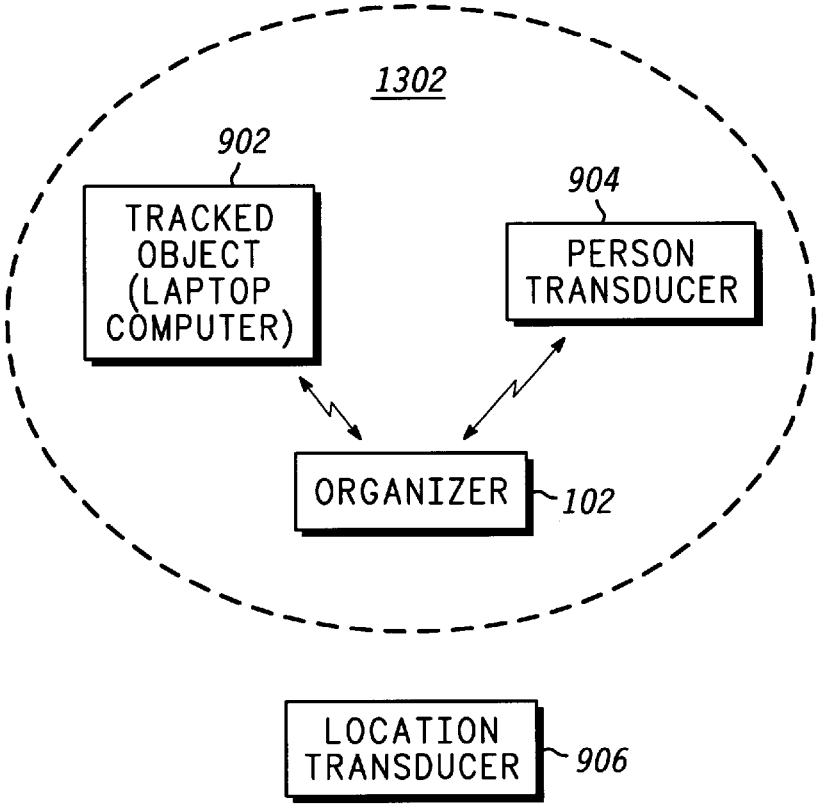
FIG. 13
FIG. 14
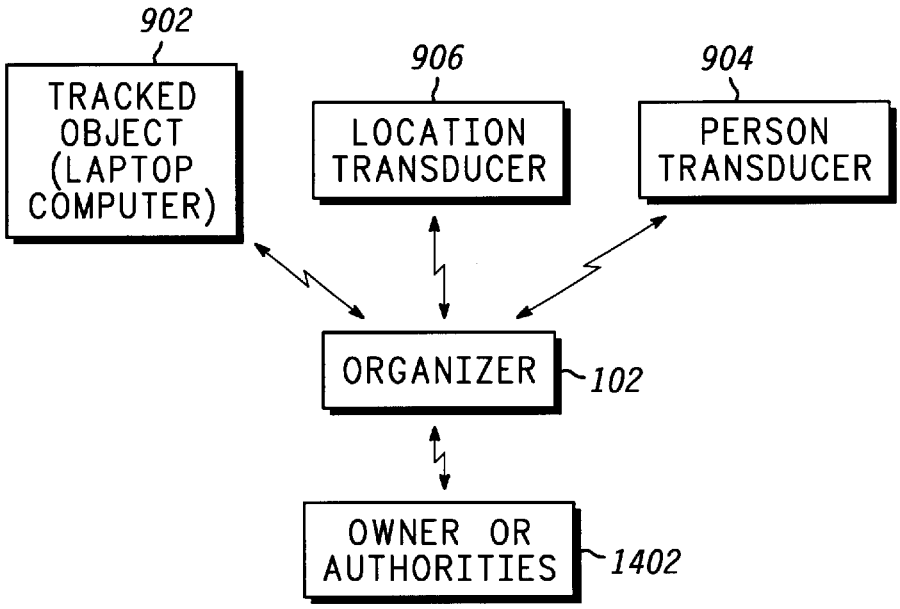

TRACKING MODE

TRACKING:
LAPTOP COMPUTER

FIG. 15

TRACKING MODE

TRACKING:
LAPTOP COMPUTER

ALARM
TRACKED DEVICE
NOT CLOSE TO TRUSTED PARTY
NOT IN TRUSTED ENVIRONMENT

FIG. 16

TRACKING MODE

TRACKING:
LAPTOP COMPUTER

ALARM
TRACKED DEVICE
NON-TRUSTED PARTY
IN TRUSTED ENVIRONMENT

FIG. 17

| TRUSTED ENVIRONMENT | TRUSTED PARTY |
|---|---|
| HOME | ALAN<br>JILL |
| ALAN'S CAR | ALAN<br>JILL |
| ALAN'S OFFICE | ALAN<br>JILL<br>FRED |
| JILL'S CAR | ALAN<br>JILL |
| JILL'S OFFICE | ALAN<br>JILL<br>KAREN |

OBJECT TRACKING APPARATUS AND METHOD

FIELD OF THE INVENTION

The invention relates generally to tracking objects. More specifically, the invention relates to reporting when an object is not near an expected location, object or person.

BACKGROUND OF THE INVENTION

People often have sets of objects that they need to have with them at different times during the day or for tasks they need to accomplish. For example, when a person leaves home to go to work in the morning, the person may need keys to the house, keys to the office, keys to the car, a wallet or purse, and a variety of other items. While in the person's car, the person may need a car key and a wallet containing the person's driver's license.

Moreover, groups of objects may be associated with each other. For example, an automobile may be equipped with a jack, a portable cell phone, a pass to a parking lot, and a variety of other things. A hand drill may have associated with it a chuck key, an extension cord, a battery and a set of drill bits, all of which may be necessary for the drill to work. A service technician dispatched to perform a particular job may need a specific set of tools and supplies to accomplish the job. Leaving the dispatch station without all of the specified objects may result in a wasted trip to retrieve the necessary tools or supplies.

Further, some of these objects may be valuable. For example, a person may desire to take a laptop computer or a personal digital assistant (PDA) to work, to a library, or to some other location where the device might be put to use. In those locations, however, the person may leave the object for a few moments, for example, to look in the library stacks, leaving the object unguarded and vulnerable to being stolen.

Clearly a need exists for tracking an object or associated group of objects in an organized fashion.

BRIEF DESCRIPTION OF THE DRAWINGS

FIG. 1 is a block diagram of an organizer system according to the present invention.

FIG. 2 is a block diagram of an organizer according to the present invention.

FIG. 4 is a block diagram of an organizer system showing sets of tracked objects.

FIGS. 5, 6, 7 and 8 are representations of organizers according to the present invention.

FIG. 9 is a block diagram of an organizer system according to the present invention.

FIG. 10 is a block diagram of an organizer system and a trusted environment according to the present invention.

FIGS. 11, 12 and 13 are block diagrams of an organizer system and a trusted environment.

FIG. 14 is a block diagram of an organizer system according to the present invention including a link to an owner or authorities.

FIGS. 15, 16 and 17 are representations of an organizer according to the present invention.

DETAILED DESCRIPTION OF THE INVENTION

Figure 3:
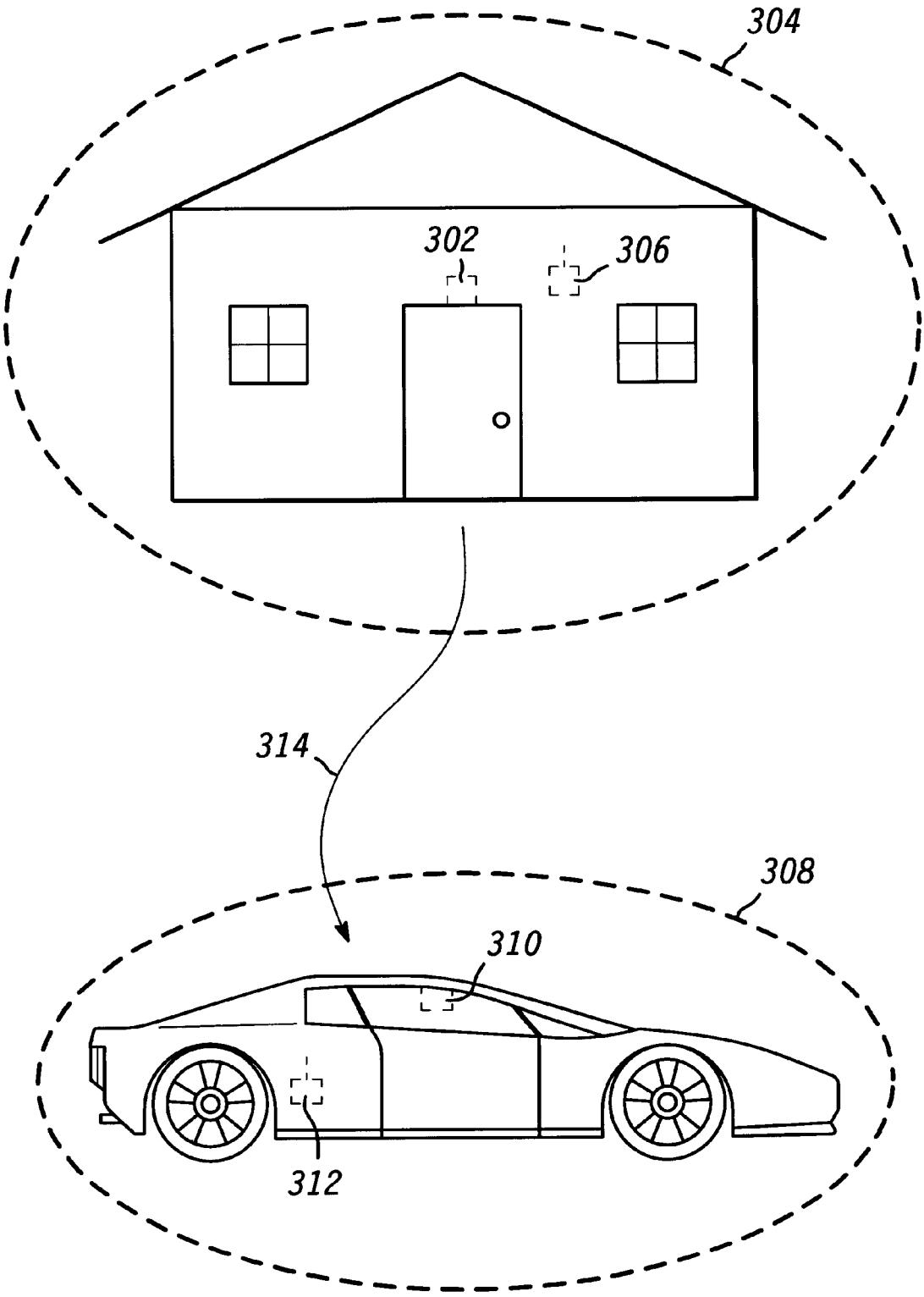
FIG. 3 is a representation of zones or environments and the devices that delimit them.

Referring to FIG. 1, an organizer 102 is capable of communicating with a variety of objects in its environment, including, for example, a wallet 104, a Pagewriter 106, a set of office keys 108, a set of home keys 110, a watch 112, a belt 114, and an arbitrary item labeled "Tag 123" 116. The organizer may be a specialized device specifically designed for the purposes discussed below or it may be a software application running on another device, such as a PDA. The objects, such as the wallet 104, the watch 112 and the belt 114, are "tagged" for identification purposes. The identification capability could be inherent within a device. For example, pagers, cell phones, and most devices which include a computer and a communications device, have the capability of identifying themselves when queried by the organizer 102.

The identification could also be done by attaching a suitable device to the objects. For example, the Massachusetts Institute of Technology is working on a device called a "penny tag" which is a small, inexpensive electronic device that upon the proper stimulation generates a unique RF signature. Such a penny tag 118 is shown attached to the belt.

Alternatively, the object, such as the watch 112, could include a transceiver 120, such as a Bluetooth transceiver, which allows the object to communicate its identity to the organizer. At the time this application was filed, the operation of a Bluetooth transceiver was described in the Bluetooth Specification, which is located at www.bluetooth.com. The transceiver could also be an optical device, using, for example, infrared communications under a protocol established by the current Infrared Data Association (IrDA) specification with standards available at www.irda.org.

The location of the devices could be determined by a variety of methods. For example, the object, such as the Pagewriter 106, could include a receiver 122 for receiving Global Positioning Satellite System (GPSS) signals which allow the object to be located within the tolerances provided by that system. Alternatively, communication systems techniques, such as time of arrival (TOA), triangulation and other such methods could be used to provide a relative distance between the organizer 102 and the objects being tracked. Relative means of location could be provided, for example, by using the relative signal strength received by the organizer in different locations, or the signal strength received by different organizers in different locations.

Further, the organizer may communicate, via any of the techniques described above, with a location transducer 124 which, for example, may be identified with an environment, such as "home" or "car." The organizer, illustrated in FIG. 2, comprises a processor 202 coupled to a memory 204. The memory 204 may be any suitable memory device, including flash memory, random access memory (RAM), read only memory (ROM), electrically alterable programmable read only memory (EAPROM), a disk drive, a CD ROM, or a combination of the above. The memory 104 may store program instructions for the processor 202 and it may store data used by the processor 202. The organizer 102 may include an input device 206 to allow a user to input commands or information. The input device 206 could be a keyboard, one or more switches, a touch screen, a combination of those devices, or any other device capable of allowing users to input information to the processor 202. The organizer includes an output device 208 coupled to the processor to allow the organizer to communicate information to a user. The output can be a display screen, indicator light or any other device capable of conveying information from the processor 202 to the user.

The organizer 102 may include a voice input device 210 to allow the organizer to receive voice inputs. If such a device is provided, instructions for causing the processor 202 to receive and interpret the voice signals are stored in the memory 204. The organizer 102 may include a speaker 212 which can be used to provide audible signals. Such signals can be used, for example, to provide alarms, verbal announcements, or other such signals. Alarms could also be displayed visually on the output device 208.

The organizer 102 may also include an interrogator 214 which allows the organizer to interrogate such responders as the penny tag 118 shown in FIG. 1. The interrogator may operate using optical principles, such as, for example, a bar code reader, or it may operate on RF principles, such as those associated with the penny tags discussed above.

The organizer 102 may also include a communications device 216. The communications device may provide optical (such as infrared) communications, radio frequency communications, such as Bluetooth communications, or any other communications technique capable of communicating the necessary information.

The location transducer 124, shown in FIG. 1, may be used to establish "zones" or "environments," as shown in FIG. 3. For example, the location transducer may be a door switch 302 which detects the opening of a door and transmits a signal to the organizer. Transducer 302 establishes a house as a zone or environment 304. Alternatively, a zone or environment may be established by the surface or border of environment 304 where the strength of the signal from the RF transmitter 306 has a specified value.

Similarly, an automobile may be established as a zone or environment 308 delimited by trigger switch 310 or RF transmitter 312.

Figures 4, 5:
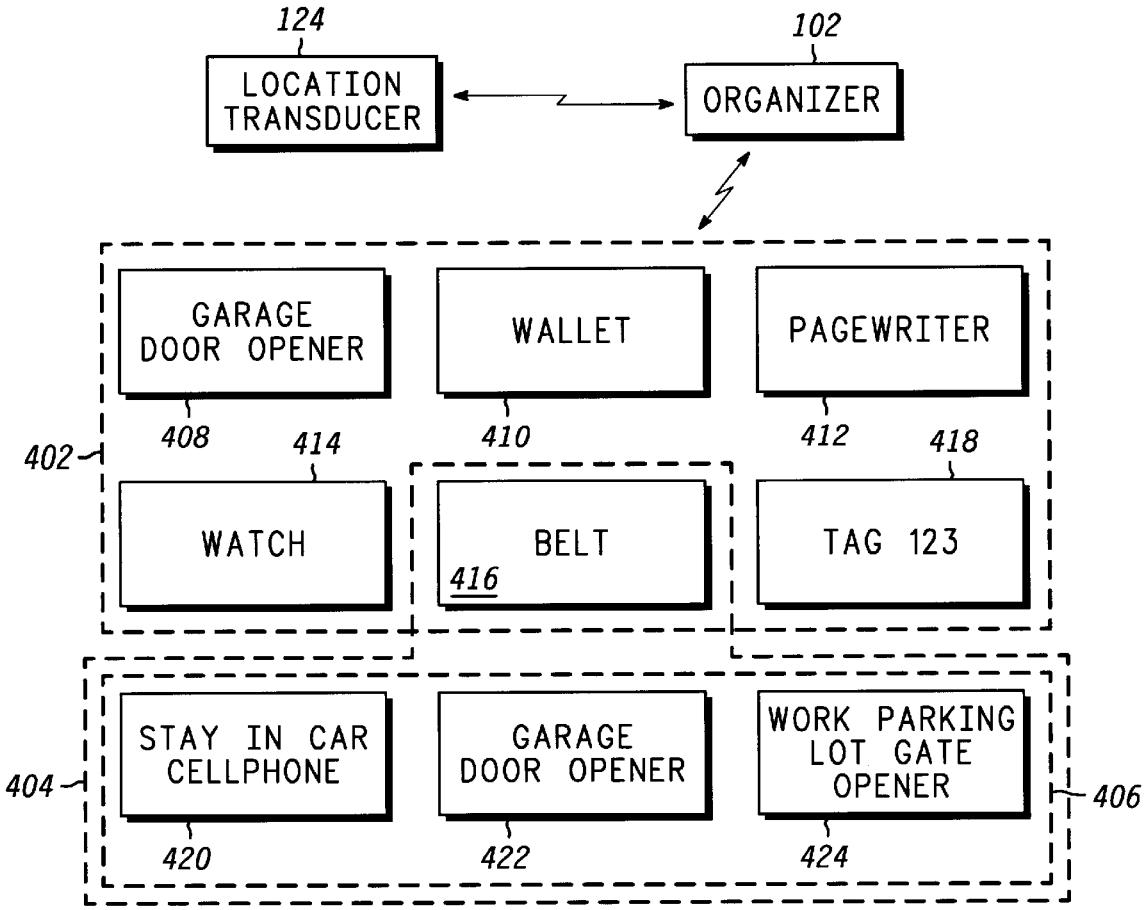

Sets of associated objects may be established, as shown in FIG. 4. The creation, modification and maintenance of the sets may be accomplished on the organizer through the organizer's human interface, or it can be done through any device with an appropriate human interface and a connection to the organizer. The human interface employed may also change according to the availability of devices. A personal computer, for instance, may allow for robust presentation of information and inputting of information. A PDA or Pagewriter may be more convenient in some circumstances.

One set of associations 402, as illustrated in FIG. 4, may include the garage door opener 408, the wallet 410, the Pagewriter 412, the watch 414, the belt 416, and Tag 123 418. A second set of associations 404 may include the belt 416, the stay-in-car cell phone 420, a garage door opener 422, and a work parking lot gate opener 424. A third set of associations 406 may include the stay-in-car cell phone 420, the garage door opener 422, and the work parking lot gate opener 424. As can be seen, the sets can overlap (e.g., sets 404 and 406).

The Pagewriter, key sets, wallet and watch may have permanently associated tags. There may be a single tag associated with all belts that the user owns, since the user just wants to associate a belt with a particular set. In the example shown in FIG. 4, the user has not yet associated a label with Tag 123.

The user may create the sets using the organizer, as illustrated in FIG. 5. Using an input device, such as a keyboard, the user creates a set of objects associated with a "leaving for work" event 502. The user specifies that the "leaving for work" event 502 occurs when (a) the organizer leaves the "home" environment 504; (b) the day of the week is Monday through Friday 506; and (c) the time of day is morning 508, as shown in FIG. 5. When the organizer 102 detects that it has left the home environment 304, (see path 314) as shown in FIG. F300, by detecting the actuation of the trigger switch 302, the reduction in the signal strength from RF transmitter 306 or detection of another environment, such as his car environment 308, and that the other conditions are met, the organizer knows to check for the presence or absence of items 510, specifically of the Pagewriter, personal keys, office keys, wallet, watch, belt and Tag 123.

FIG. 6 also illustrates a second set associated with the event "his car" 602 which occurs when (a) the organizer is detected entering "Allen's car" 604 and (b) the "leaving for work" 606 conditions are satisfied when applicable (i.e., Monday through Friday morning). For this event, the user has selected the stay-in-car cell phone and the work parking lot gate opener as items 608 whose presence or absence must be ascertained.

Once the organizer has been set up with different sets and associations to events, the organizer will track the objects in the sets and provide the user with indications when the objects are not appropriately accounted for, for example present, as shown in FIGS. 7 and 8. In FIG. 7, the "leaving for work" event 502 has occurred, the organizer has interrogated the environment and does not sense the presence of the office keys and the belt. Accordingly, the organizer presents an alarm to the user. The alarm could also be audible when made via the speaker 212. The organizer may interrogate its environment on a sporadic basis, an occasional basis, or only when the interrogator enters the environment.

The user can then choose to ignore the alarm by pressing a button or tapping a screen in the appropriate spot, depending on the implementation of the organizer, or the user can find the missing item. For example, as shown in FIG. 7, the user must find the office keys in order to drive to work. In contrast, the user may or may not need the belt. In the event the user decides that the belt is not necessary, the user taps the ignore box and the organizer removes the alarm. Upon the recurrence of the same event or the occurrence of a subsequent event, the organizer may inquire whether the user wants to continue to ignore the missing belt.

Similarly, with respect to FIG. 8, when the user enters his car 602, the organizer queries the nearby devices to determine if the associated set of devices is present. The organizer determines that the work parking lot gate opener is missing and provides an alarm to the user. The user then has the option of deciding to proceed without the missing object or to locate the missing object.

The lists of objects associated with a set may grow, shrink, or be redefined as the user moves from place to place. The user can define sets that include all tagged objects for a particular location, or a set may include other sets. In one instance, the user may have a list of objects the user always carries and add objects that are necessary or useful in other locations. For example, the user may always carry a watch and a wallet and those objects may form a set called, for example, "always carry." The sets for other locations may include specific items and the "always carry" set.

While the above description refers to people and their things, the invention could also be applied to things that require other things to work properly. An electrical drill, for example, may be associated with a set that includes a chuck key, drill bits, and an extension cord.

Preferably, there are multiple instances of the organizer. For example, a first organizer may be a cell phone and a computer system in the car may be a second organizer. In this instance, the computer will detect the cell phone entering the car and allow the cell phone to perform the organizer function while both are present.

When multiple organizers exist, they may communicate with each other to synchronize their sets. For example, if a PDA is an organizer and the user changes one of the sets using the PDA's human interface, the revised set will be communicated to other organizers that the PDA organizer encounters. Alternatively, the organizer could ask the user's permission before making the change to a set.

The synchronization feature may be an automatic feature or a feature that must be invoked by the user. This could be accomplished either by a message on the organizer informing the user that an updated set exists on another organizer and therefore needs to be updated, or a selection on a screen could cause the organizer to synchronize with any organizers with which it is in communication.

After determining that one of the tracked items is missing, the organizer may transmit a message via its communication device 216 to any devices capable of receiving such a message to assist the organizer in finding the object for the user. Any device receiving the communication from the organizer may pass the message along to other devices, either via RF or optical link or via a network. Each of the devices receiving the message may have the facility to perform a search for the missing object. Once the missing object is found, a message is relayed back to the organizer which displays a message to the user directing the user to the location of the missing object.

The organizer may also detect and report the presence of too many of a particular item. For example, if a family owns two garage door openers and the organizer senses upon entering the car that there are two garage door openers responding to interrogation, the organizer may present a message to the user suggesting that the user leave one of the garage door openers behind for use by other members of the family.

The organizer may also employ the concepts of "trusted people" and "trusted environments" in a theft prevention mode, as illustrated in FIG. 9. In this mode, the organizer 102 is in communication with a tracked object 902, such as a laptop computer, a person transducer 904, and a location transducer 906. The location transducer can be one of the items illustrated in FIG. 3, such as the door switch 302 or the RF transmitter 306.

The person transducer 904 is a transducer associated with a PDA, a pager, a cell phone, or any other device capable of receiving an interrogation signal and responding with an identity associated with a particular person. For example, a V-card is an application that runs on, for example, a PDA and provides an electronic business card when it is interrogated.

In the situation illustrated in FIG. 10, the location transducer 906 indicates that the organizer 102 is in a trusted environment 1002. For example, the trusted environment may be that around the house 304 or that around the car 308 illustrated in FIG. F300. The organizer 102 can determine that the tracked object 902 is in the trusted environment 1002 and the person transducer 904 is also in the trusted environment 1002. If the person transducer 904 is associated with a trusted person, then the organizer does nothing. In contrast, if the person transducer 904 is not associated with a trusted person, the organizer announces an alarm to the user.

Figure 11:
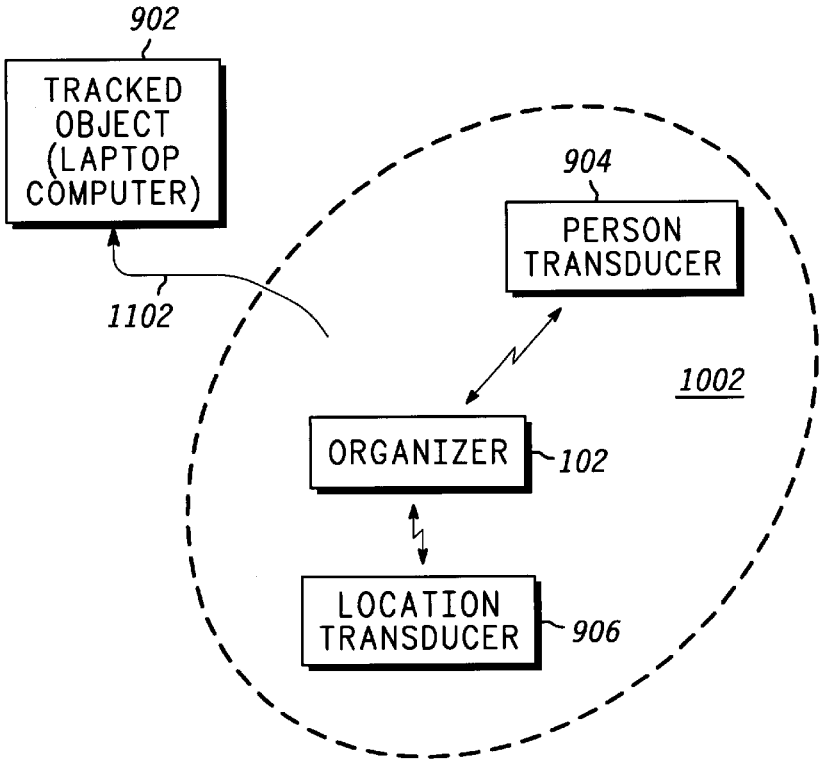

If the tracked object 902 leaves 1102 the trusted environment 1002, as illustrated in FIG. 11, the organizer raises an alarm to the user. The organizer may detect the tracked object leaving the trusted environment through a reduction in signal strength from the tracked object, through reporting from other devices which sense the presence of the tracked object in other environments, or through other techniques such as a GPS reading from the object.

Figure 12:
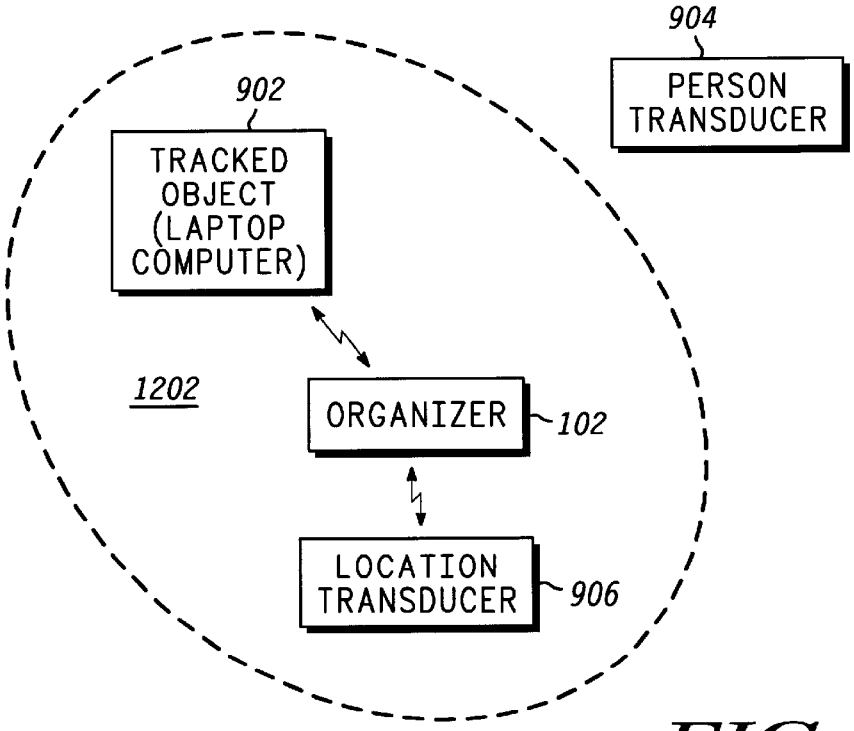

The organizer may raise an alarm when the tracked object 902 is in an environment or zone 1202 which is not a trusted environment or when the organizer 102 determines that the person transducer 904 associated with a trusted person is not in the same environment, as shown in FIG. 12.

The organizer may also raise an alarm if it loses contact with the location transducer 906, or the person transducer 904 is not associated with a trusted person as shown in FIG. 13. In this instance, the zone or environment 1302 may be unknown.

The alarm can be reported 1404 via optical or electronic means to the owner or authorities 1402, as illustrated in FIG. 14. Further, the organizer can display a message, as shown in FIGS. 15, 16 and 17. In FIG. 15, the organizer provides an indication that it is tracking a laptop computer. In FIG. 16, the organizer provides an indication that the tracked device is not close to a trusted party and that it is not in a trusted environment. In FIG. 17, the organizer displays an alarm that a tracked device is in a trusted environment with a non-trusted party.

Figures 18, 19:
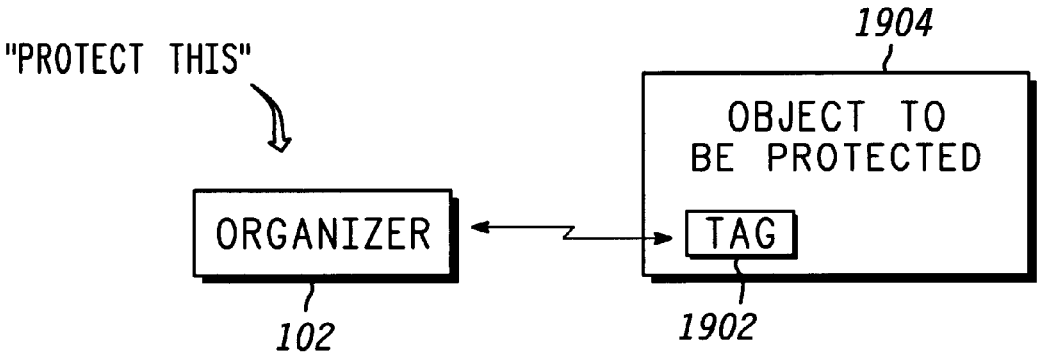
FIG. 18 is a representation of a table of trusted environments and trusted parties according to the present invention.
FIG. 19 is a block diagram of an organizer system according to the present invention.

The trusted parties associated with different trusted environments can be different. The organizer maintains a table 1802, illustrated in FIG. 18, that indicates the trusted environments and the trusted people for that environment. The table shown in FIG. 18 is indexed by trusted environment. Alternatively, the table could be indexed by trusted people.

The organizer knows the owner of the laptop computer as a trusted party and learns about other trusted parties. New trusted parties are either explicitly pointed out as such by an already trusted party or become trusted by regular proximity or information exchange with an already trusted party. From time to time, the user may be prompted to review new additions to the trusted party lists and their associations with trusted environments.

The organizer can also learn about new trusted environments. Trusted environments may be explicitly identified by a trusted party. An environment may become a trusted environment for a particular item if a trusted party often is located in that environment. Alternatively, an environment can become a trusted environment for a monitored object if the object is often within that environment or is often there with its owner.

An object can be added to a set by using, for example, voice commands to the organizer while the new object to be added to the set is sensed by the organizer, as illustrated in FIG. 19. When the organizer detects the tag 1902 associated with the new object 1904 and receives the verbal command "protect this," it will display the identity of the newly-added object along with a question to the user asking to which sets the object should be added.

In the foregoing the organizer 102 as earlier noted and may of the other items include some form of processor. It is understood that these processors are executing software or firmware pursuant to operating in accordance with the teachings herein. While the software has not been specifically discussed the development thereof is well within the skills of one of ordinary skill given the principles and teaching disclosed herein.

The foregoing describes preferred embodiments of the invention and is given by way of example only. The invention is not limited to any of the specific features described herein, but includes all variations thereof, within the scope of the appended claims.

What is claimed is:

1. A tracking apparatus comprising:

a tracked object interrogator producing a tracked object identifier output;

a location interrogator producing an apparatus location output corresponding to its proximity relative to a location transducer; and an alarm which annunciates for a predetermined combination of the apparatus location output and the tracked object identifier output.

2. The tracking apparatus of claim 1, wherein the tracked object interrogator produces a plurality of tracked object identifier outputs; and the alarm annunciates for predetermined combinations of the apparatus location output and the tracked object identifier outputs.

3. The tracking apparatus of claim 2, wherein the apparatus location output has one or more expected apparatus location outputs;

the tracked object identifier output has one or more expected tracked object identifier outputs;

each expected apparatus location output has associated with it a set of the one or more expected tracked object identifier outputs.

4. The tracking apparatus of claim 3, wherein one or more factors determines the set of one or more expected tracked object identifier outputs that is associated with an expected apparatus location.

5. The tracking apparatus of claim 3, wherein the set of one or more expected tracked object identifier outputs associated with an expected apparatus location is a union of one or more other sets of expected tracked object identifier outputs.

6. The tracking apparatus of claim 3, wherein each tracked object identifier output has a first value if a corresponding tracked object responds to a tracked object interrogator, and a second value otherwise; and the alarm annunciates for each tracked object identifier output having the second value.

7. The tracking apparatus of claim 3, wherein the alarm annunciates differently for each tracked object identifier having a second value.

8. The tracking apparatus of claim 1, wherein the tracked object identifier output comprises a location of a tracked object;

the apparatus location output comprises a location of the tracking apparatus; and the alarm annunciates if the location of the tracked object is different from the location of the tracking apparatus by a predetermined amount.

9. The tracking apparatus of claim 1, further comprising a means for locating a tracked object associated with the predetermined combination of the apparatus location output and the tracked object identifier output.

10. A tracking apparatus comprising:

a tracked object interrogator producing a tracked object identifier output;

a location interrogator producing an apparatus location output;

a person interrogator producing a person identifier output; and an alarm which annunciates for a predetermined combination of the apparatus location output, the tracked object identifier output, and the person identifier output.

11. The tracking apparatus of claim 10 wherein the apparatus location output comprising one or more expected apparatus location outputs, the one or more expected apparatus location outputs comprising a trusted environment;

the person identifier output comprising one or more expected person identifier outputs, the one or more expected person identifier outputs comprising a trusted person.

12. The tracking apparatus of claim 11 wherein the alarm annunciates if the apparatus location output is not a trusted environment and the person identifier output is not a trusted person.

13. The tracking apparatus of claim 11 further comprising a trusted environment identifier configured to allow a trusted person to identify an environment as a trusted environment.

14. The tracking apparatus of claim 11 further comprising a trusted environment identifier configured to identify an environment as a trusted environment if a trusted person is in the environment more than a predetermined number of times in a predetermined period of time.

15. The tracking apparatus of claim 11 further comprising a trusted person identifier configured to allow a trusted person to identify a person as a trusted person.

16. The tracking apparatus of claim 11 further comprising a trusted person identifier configured to identify a first person as a trusted person if a second trusted person is near the first person more than a predetermined number of times in a predetermined period of time.

17. A method for monitoring a protected object comprising designating one or more environments as trusted environments;

designating one or more persons as trusted persons;

sensing whether the protected object is in a trusted environment;

sensing whether the protected object is proximate to a person and whether that person is a trusted person;

annunciating an alarm for a predetermined combination of sensed environment and sensed person.

18. The method of claim 17 wherein the predetermined combination comprises an environment that is not a trusted environment and no trusted person is proximate.

19. The method of claim 17 wherein designating environments comprises identifying a candidate environment explicitly as a trusted environment.

20. The method of claim 17 wherein designating environments comprises sensing the protected object in a candidate environment and sensing a trusted person in the candidate environment more than a predetermined number of times in a predetermined period of time.

21. The method of claim 17 wherein designating persons comprises identifying a candidate person explicitly as a trusted person.

22. The method of claim 17 wherein designating persons comprises sensing the candidate person proximate to a trusted person more than a predetermined number of times in a predetermined period of time.

* * * * *